US010475276B2

(12) United States Patent
Hohman et al.

(10) Patent No.: US 10,475,276 B2
(45) Date of Patent: Nov. 12, 2019

(54) GAMING MACHINE HAVING DOOR WITH EXTENDED OPENING AND CLOSING CONTROL

(71) Applicant: AGS LLC, Las Vegas, NV (US)

(72) Inventors: Kevin Lee Hohman, North Las Vegas, NV (US); Mark Robert Brandau, Johns Creek, GA (US)

(73) Assignee: AGS LLC, Las Vegas, NV (US)

( * ) Notice: Subject to any disclaimer, the term of this patent is extended or adjusted under 35 U.S.C. 154(b) by 44 days.

(21) Appl. No.: 15/703,645

(22) Filed: Sep. 13, 2017

(65) Prior Publication Data

US 2019/0080553 A1 Mar. 14, 2019

(51) Int. Cl.
*G07F 17/32* (2006.01)

(52) U.S. Cl.
CPC ..... *G07F 17/3216* (2013.01)

(58) Field of Classification Search
CPC . G07F 17/3216; E05C 17/32; Y10T 16/54052
See application file for complete search history.

(56) References Cited

U.S. PATENT DOCUMENTS

| | | | | | |
|---|---|---|---|---|---|
| 4,475,267 | A * | 10/1984 | Hathaway | E05C 17/32 | 108/160 |
| 5,211,457 | A * | 5/1993 | Lupynec | A47B 63/02 | 16/370 |
| 5,676,231 | A * | 10/1997 | Legras | G07D 11/0006 | 194/206 |
| 6,976,919 | B2 | 12/2005 | Cole | | |
| 7,267,613 | B2 | 9/2007 | Cole | | |
| 2004/0018870 | A1 | 1/2004 | Cole | | |
| 2008/0227554 | A1 * | 9/2008 | Cole | G07F 17/32 | 463/46 |
| 2016/0343204 | A1 * | 11/2016 | Maher | G07F 17/3216 | |

* cited by examiner

*Primary Examiner* — Lawrence S Galka
(74) *Attorney, Agent, or Firm* — Weide & Miller, Ltd.

(57) ABSTRACT

A gaming machine has a cabinet which defines one or more interior areas and has at least one access door or panel which is movably mounted to the cabinet to selectively provide access to the interior area(s). A door control comprises a scissor arm and a door shock. The scissor arm comprises first and second links which are rotatably connected at a joint and connect to the cabinet and access door, thus permitting a wide range of movement of the access door. The door shock mounts to the cabinet and the scissor arm, thus controlling movement of the scissor arm.

19 Claims, 4 Drawing Sheets

FIG. 2A
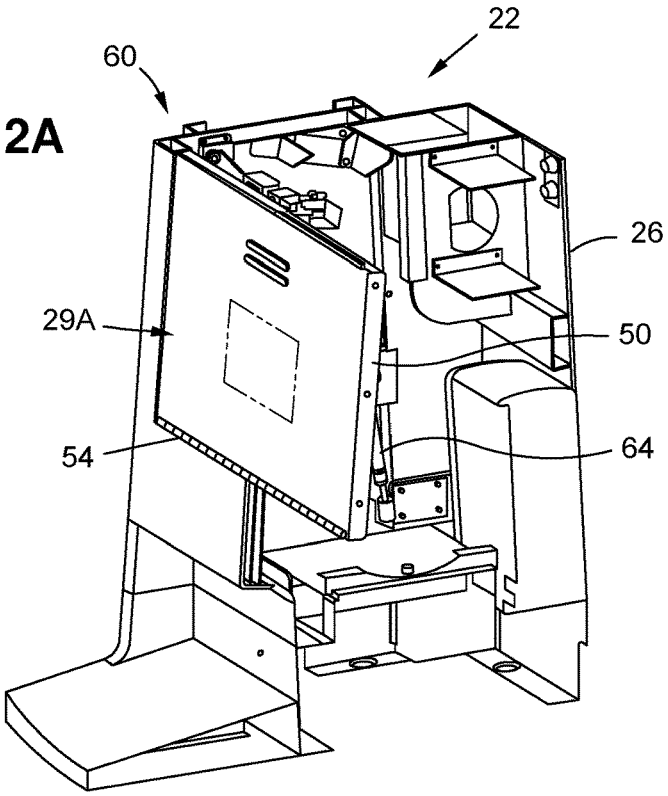
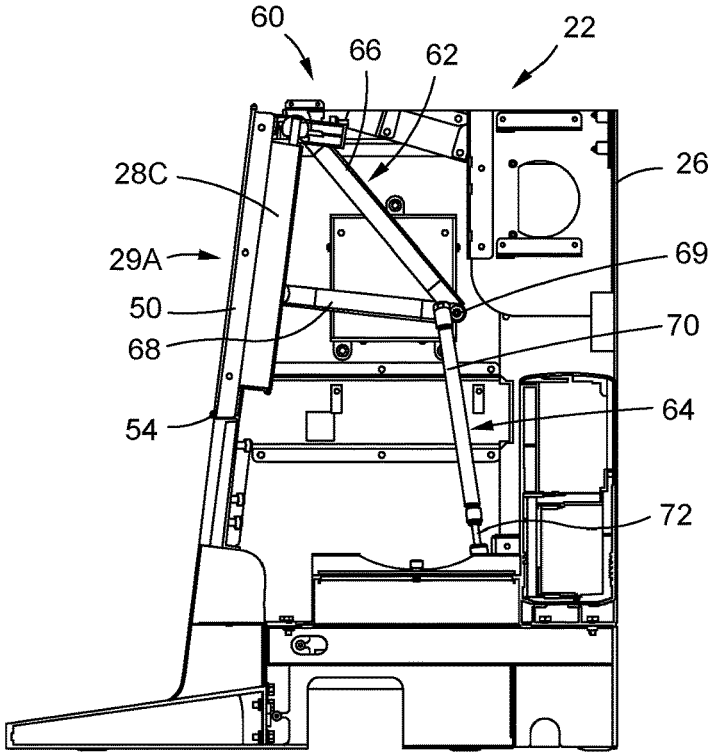
FIG. 2B

FIG. 3A
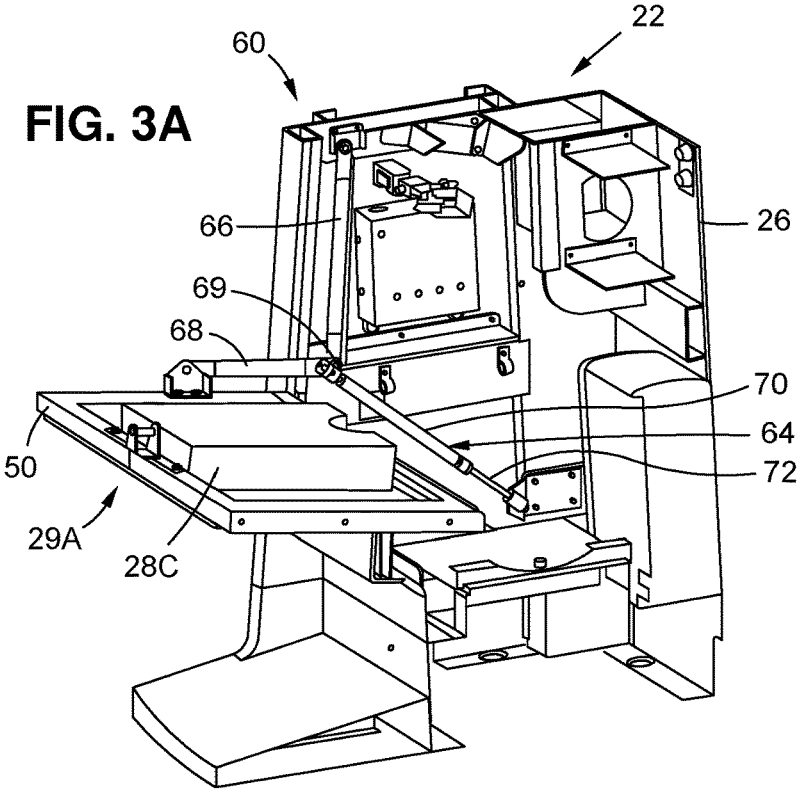
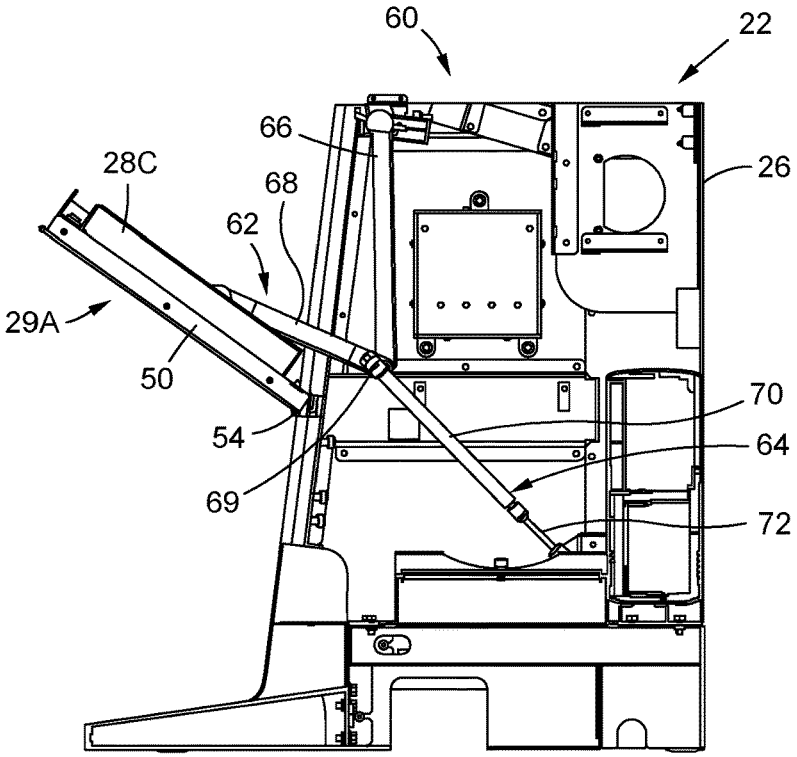
FIG. 3B

FIG. 4A
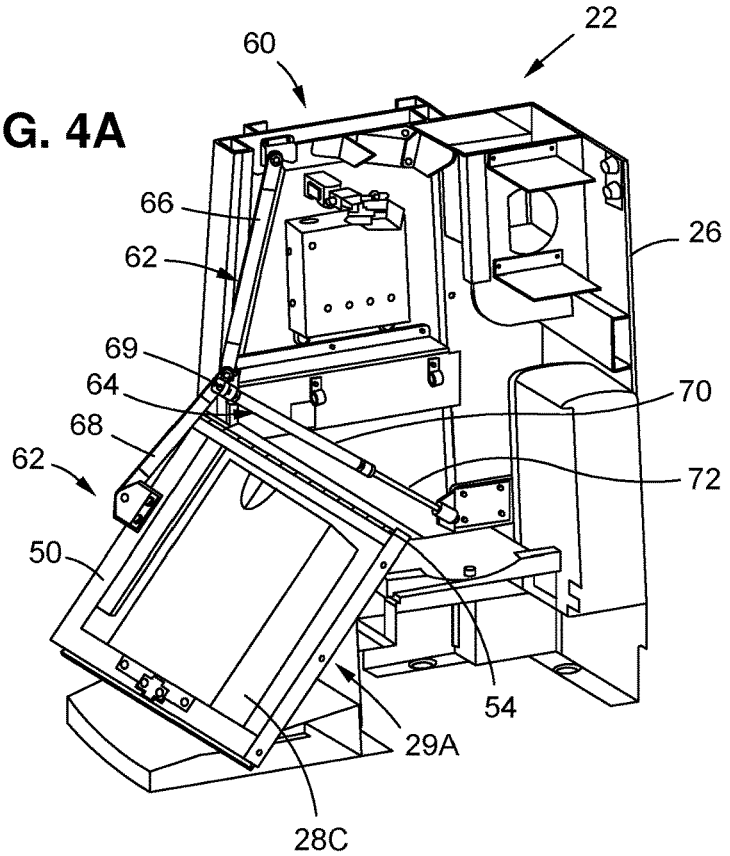
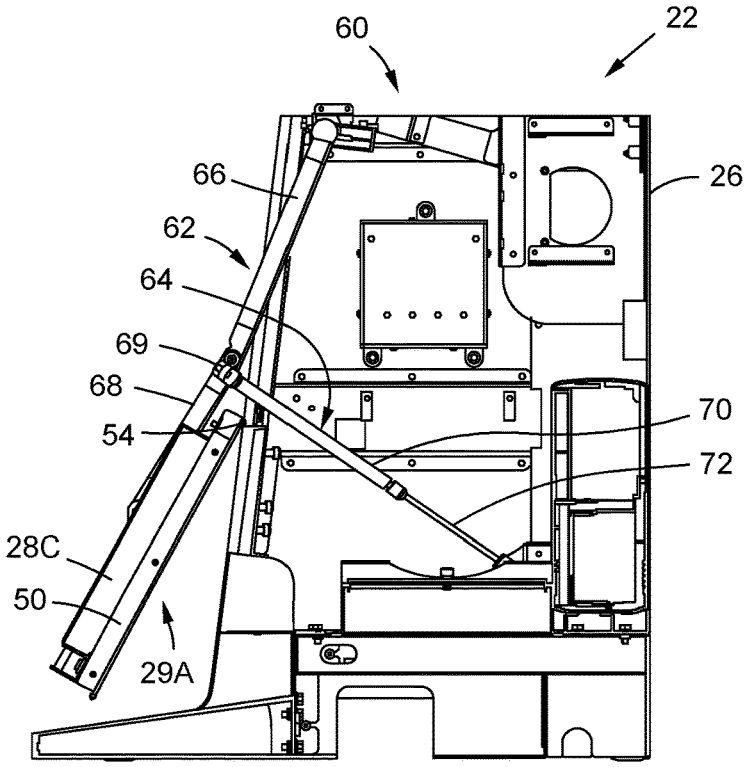
FIG. 4B

GAMING MACHINE HAVING DOOR WITH EXTENDED OPENING AND CLOSING CONTROL

FIELD OF THE INVENTION

The present invention relates to wager-based gaming machines and similar devices which include doors or panels which may be opened and closed to gain access to interior portions thereof.

BACKGROUND OF THE INVENTION

Wager-based gaming machines are tightly controlled. To prevent tampering with the components of the machines, such as the gaming controller, many of the components of the gaming machine are located within an interior space of the gaming machine. Access is provided to the interior, such as for maintenance personnel, via one or more access doors or panels. Generally, these access doors or panels are locked.

Many of the gaming machine components are relatively sensitive. As a result, maintenance personnel must be careful when opening and closing the access doors and panels to prevent damage to the gaming machine. For example, the access doors may be heavy and may support other components. If a user allows the door to swing open very quickly, it may hit another portion of the gaming machine and then cause damage to the gaming machine.

In some cases, damping mechanisms have been used to dampen movement of a gaming machine door, such as disclosed in U.S. Publication No. 2004/0018870. Existing gaming machine door controls such as this one have various drawbacks. One drawback is that the range of movement of the door may be greatly limited, such as to the travel distance of door shock. This can then limit access to the interior of the gaming machine, impeding maintenance personnel and the like.

An improved gaming machine door opening and closing control is desired.

SUMMARY OF THE INVENTION

Embodiments of the invention comprise a gaming machine with an extended opening door having an opening and closing control and methods of controlling the movement of a gaming machine door between open and closed positions.

In one embodiment, a gaming machine of the invention comprises a cabinet defining at least one interior space, an access door mounted to the cabinet by at least one hinge allowing the access door to move between a first closed position and a second open position, at least one display device, at least one player input device, a memory device, a controller, machine-readable code stored in the memory device and executable by the controller to present one or more wagering games comprising the display of game information via the at least one display device, and an access door control comprising a scissor arm connected to the access door and the cabinet and a shock mounted to the cabinet and the scissor arm.

In one embodiment, the scissor arm may comprise a first link and a second link which are rotatably connected at a joint. In one embodiment, a first end of the first link is mounted to the gaming machine cabinet, a first end of the second link is mounted to the access door and the second ends of the first and second links are connected at the joint. The shock may comprise a body with an extendable and retractable arm where one end of the shock is mounted to the gaming machine cabinet and the other end is mounted to the scissor arm, such as at the joint.

In one embodiment, the access door is mounted to the cabinet by at least one hinge along a lower edge of the access door, allowing the access door to rotate about a horizontal axis from a first raised, closed position to a second lowered, open position.

In one embodiment, the scissor arm and shock are in a collapsed position when the access door is closed and the scissor arm and shock expand to extended positions when the access door is opened. The shock controls the movement of the scissor arm, while permitting an extended range of door movement. The invention thus results in a controlled, extended range of door movement which would not be attainable but for the configuration of the invention, in contrast to prior door controls such as described in the above-referenced prior art.

Further objects, features, and advantages of the present invention over the prior art will become apparent from the detailed description of the drawings which follows, when considered with the attached figures.

DESCRIPTION OF THE DRAWINGS

FIGS. 2A and 2B are isometric and plan side views of the extended opening door of the gaming machine illustrated in FIG. 1 in shown a first, closed position;

FIGS. 3A and 3B are isometric and plan side views of the extended opening door of the gaming machine illustrated in FIG. 1 in shown a second, partially open position; and FIGS. 4A and 4B are isometric and plan side views of the extended opening door of the gaming machine illustrated in FIG. 1 in shown a third, fully open position.

DETAILED DESCRIPTION OF THE INVENTION

Figure 1:
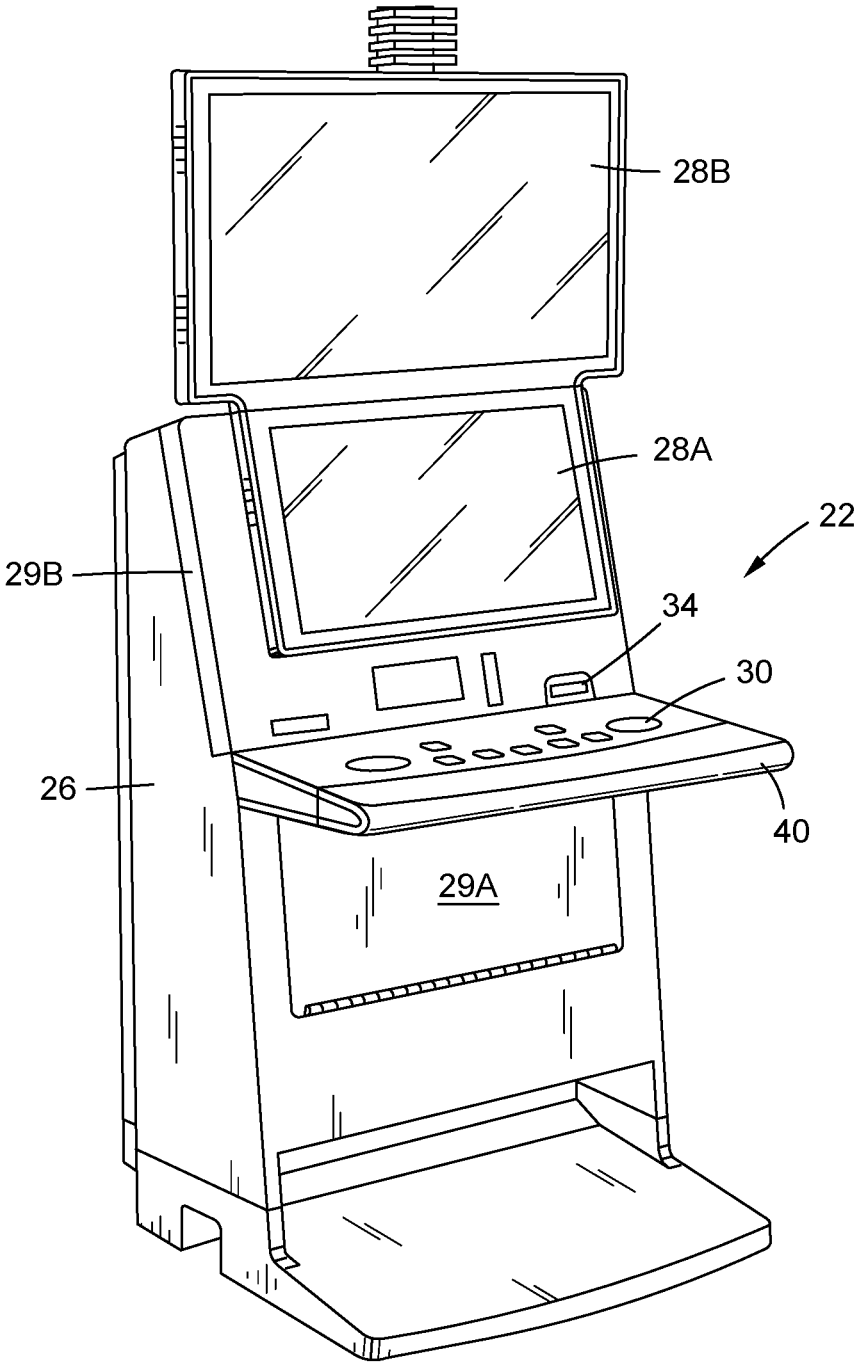
FIG. 1 illustrates one embodiment of a gaming machine having an extended opening door in accordance with the invention.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise gaming machines having extended opening doors, configurations of extended opening doors and methods of mounting and moving such doors.

One embodiment of the invention comprises a gaming machine with an extended opening door. Most preferably, the extended opening door includes an opening and closing control.

A gaming machine in accordance with the invention may have various configurations. The gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

One configuration of a gaming machine 22 is illustrated in FIG. 1. As illustrated, the gaming machine 22 generally comprises a housing or cabinet 26 for supporting and/or enclosing various components required for operation of the gaming machine. The cabinet 26 preferably includes one or more doors 29A,B or other access panels or features which can be moved between an open position which allows access to one or more interior portions of the gaming machine, and a closed position in which access to the one or more interior portions is generally prevented. The doors 29A,B may include locks or other features for securing them in their closed positions.

The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one display device configured to display game information. The display device may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display device may be capable of projecting or displaying a wide variety of information, including images, symbols and other indicia or information associated with game play, game promotion or other events. The gaming machine 22 might include more than one display device, such as two or more video displays which are associated with the cabinet 26. For example, the gaming machine 22 illustrated in FIG. 1 includes a main video display 28A which is located at a front of the cabinet 26 and a secondary video display 28B which is positioned above the main video display 28A and extends above a top portion of the cabinet 26. The gaming machine 22 might also include a top box or other portion. Such a top box might include one or more display devices, such as in addition to one or more main displays which are associated with the cabinet 26. Also, the gaming machine 22 might include side displays (such as mounted to the exterior of the cabinet 26) and might include multiple displays of differing sizes.

While the display devices may comprise one or more video displays, (such as for presenting video poker, video slots or other video-based games) in another embodiment, the gaming machine 22 may include one or more physical reels capable of displaying game information, such as slot symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. The principal of such an arrangement is described in U.S. Pat. No. 4,448,419 to Telnaes, which is incorporated herein by reference.

As described in more detail below, the gaming machine 22 is preferably configured to present one or more games upon a player making a monetary payment or wager. In this regard, as described in more detail below, the gaming machine 22 includes a mechanism or means for accepting monetary value.

In one embodiment, certain game outcomes (but preferably not all game outcomes) may be designated as winning outcomes (the non-winning outcomes may be referred to as losing outcomes). Prizes or awards may be provided for winning outcomes, such as monetary payments (or representations thereof, such as prize of credits), or promotional awards as detailed herein. As detailed below, the gaming machine 22 preferably includes a mechanism or means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to "cash out" of the gaming machine, or to provide various other inputs. As illustrated, a button deck 40 may extend outwardly from the front of the cabinet 26 towards the player. The button deck 40 may support, for example, one or more of the input devices 30, such as buttons, a touch screen or the like.

In one preferred embodiment, the gaming machine 22 includes at least one microprocessor or controller for controlling the gaming machine, including receiving player input and sending output signals for controlling the various components or peripheral devices of the machine 22 (such as generating game information for display by the displays 28A,28B). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the display 28A28B, for determining winning or losing game outcomes and for displaying information regarding awards for winning game outcomes, among other things.

The controller may be configured to execute machine readable code or "software" or otherwise process information, such as obtained from a remote server. Software or other instructions may be stored at a memory or data storage device, e.g. in a fixed or non-transitory configuration. The memory may also store other information or data, such as data stored in table or other forms (including, but not limited to look-up tables, pay tables and other information, including tracked game play information). The gaming machine 22 may also include one or more random number generators for generating random numbers (such as implemented by a random number generator software module stored in the memory and executable by the processor or controller), such as for use in selecting game information and presenting the game in a random fashion (e.g. whereby the game is presented in a manner in which the player cannot control the outcome) or pseudo-random fashion (e.g. such as where the game includes a skill component which can affect the outcome of the game).

Preferably, the controller is configured to execute machine readable code or instructions (e.g. software) which are configured to implement the game. In this regard, the gaming machine is specially configured to present the game of the invention via specific software and/or hardware which causes the gaming machine to operate uniquely. For example, the controller of the gaming machine 22 may be configured to detect a wager, such as a signal from a player's depressing of the "bet one" button (such as one of the buttons 30). Upon such an event and/or the player otherwise signaling the gaming machine to present the game, the controller may be configured to cause the at least one display 28 to display unique information, such as a unique graphical interface or unique game display, including game symbols or other game information (such as graphically represented images of cards, slot symbols, dice, etc.). The controller may accept input from a player of game inputs, such as a request to spin reels or the like, via the one or more player input devices of the gaming machine 22. As indicated above, the machine-readable code may be configured in various manners, such as by having various "modules" of software which are designed to implement specific features of the game play or game presentation.

The gaming machine 22 may be configured to generate and present games in a stand-alone manner or it may be in communication with one or more external devices at one or more times. For example, the gaming machine 22 may be configured as a server based device and obtain game code or game outcome information from a remote game server (in which event the gaming machine controller may receive game information from the server, such as game outcome information, and use that server-generated information to present the game at the gaming machine). For example, the gaming machine 22 might be configured as a stand-alone device or as a server-based device for presenting games as Class III games (as defined by the U.S. Indian Gaming Regulatory Act) or as a server-based device for presenting games as Class II games (as defined by the U.S. Indian Gaming Regulatory Act).

As indicated, the gaming machine 22 is configured to present one or more wagering games. The gaming machines 22 is preferably configured to accept value, such as in the form of coins, tokens, paper currency or other elements or devices representing value such as monetary funds. Thus, as indicated above, the gaming machine 22 preferably includes a mechanism or means for accepting monetary value. For example, while not shown in FIG. 1, the gaming machine 22 might include a coin acceptor for accepting coins. Of course, associated coin reading/verifying devices and coin storage devices may be associated with the gaming machine 22 if it is configured to accept coins. Likewise, the gaming machine 22 might include a currency accepting device having an acceptor slot or opening 34. Such a device may be configured to accept and read/verify paper currency and/or other media such as tickets.

The gaming machine 22 might also be configured to read FOB s, magnetic stripe cards or other media having data associated therewith and via which value or funds may be associated with the gaming machine 22. The mechanism for accepting monetary value might also comprise hardware and/or software which allows a player to transfer (such as electronically) funds from an account, such as a casino wagering account, or a bank or other financial institution account. Such a mechanism might include a communication interface which permits the gaming machine to communicate with a mobile phone, PDA, tablet or other electronic device of the player (such as via a physical interface or wired or wireless communications links, such as to enable the transfer of funds from the player to the gaming machine or system).

When the player associates funds with the gaming machine or an associated system, a credit balance is generated. The credit balance may comprise a plurality of monetary value credits. The player may wager some or all of the associated monetary value, such as by wagering one or more of the credits associated with the credit balance. For example, the player might provide input to a wager button or touch screen interface to wager a certain number of credits (such as "Bet 1 Credit", "Bet 5 Credits", "Bet Maximum Credits" or other options). In one embodiment, when the player's wager is received, the player's credit balance is reduced by the number of wagered credits. The player might then provide a separate input to begin the game. In other embodiment, the player might select a "play game" input, such as by pressing a "spin" button, which input is taken to comprise both an instruction to place a wager (such as of a pre-set or pre-selected number of credits) and to start the game. Of course, other configurations may be implemented for accepting monetary value from the player and for allowing the player to place a wager from the associated monetary value.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. These winnings may be associated with the player's credit balance, thus increasing the player's credit balance.

In one embodiment, the player may provide an input to the gaming machine 22 to indicate their desire to cash out, such as by selecting a "cash out" button (such as implemented via one of the buttons 30) or touch screen feature or providing other input. In response, a monetary value represented by the player's credit balance or the like is preferably paid, transferred or otherwise provided to the player. For example, upon an award or at cash-out, associated funds may be paid to the player by the gaming machine 22 dispensing coins to a coin tray. In another embodiment, funds may be issued by dispensing paper currency or other media. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference. In yet another embodiment, the cash-out might result in the dispensing of a card or other media which stores or represents the cashed-out funds, such as by writing funds information to a magnetic stripe of a card which is inserted into a media writer of the gaming machine or dispensed from the machine. In other embodiments, the cash-out mechanism may result in the funds value being transferred to an external device or account, such as a player's casino account (such as associated with a casino server), a remote bank or other financial account, or an electronic device such as a player's phone, PDA or tablet.

The gaming machine 22 may also include a player tracking device, such as a card reader and associated keypad. Such player tracking devices are well known and may permit the game operator to track play of players of the gaming machine. The tracked play may be utilized to offer player bonuses or awards.

A casino may have numerous such gaming machines 22, such as located on a casino floor or in other locations. Of course, such gaming machines 22 might be used in other environments, such as an airport, a bar or tavern or other locations.

It will be appreciated that the gaming machine illustrated in FIG. 1 is only exemplary of one embodiment of a gaming machine. For example, it is possible to for the gaming machine to have various other configurations, including different shapes and styles and having different components than as just described.

As noted, the gaming machine 22 may, as noted above, be part of a system which includes other devices. For example, the gaming machine 22 may communicate with one or more casino systems, such as a player tracking server or system, an accounting system or server, a ticketing system, a bonusing system, a tournament system, other gaming machines, and external devices.

The gaming machine 22 preferably includes at least one extended opening door. The extended opening door preferably includes at least one opening and closing control. One embodiment of such an extended opening door 29A and a gaming machine 22 having such a door 29A, will be described in more detail with reference to FIGS. 2A,B, 3A,B and 4A,B. These figures illustrate a portion of the gaming machine 22 illustrated above in cut-away.

An example of the invention is provided relative to the lower door 29A of the gaming machine 22. It will be appreciated that the principles of the invention could be applied to the upper door 29B (see FIG. 1) or to gaming machines having doors in other locations. Also, the principles of the invention might be applied to other types of doors, such as gaming machine access panels and the like.

FIGS. 2A and 2B illustrated the door 29A in a closed position. In this embodiment, the door 29A comprises a frame or body 50 and an associated video display 28C (see FIG. 2B) which is supported by the frame, such as for projecting or providing information. The door 29A is movably mounted to the cabinet 26 of the gaming machine 22. In this embodiment, the door 29A is rotatably mounted to the cabinet 26 via one or more hinges 54 which connect a lower portion or edge of the frame 50 to the cabinet 26. As described in more detail below, in this embodiment, the door 29A is permitted to rotate about a horizontal axis.

In this configuration, apart from any locking mechanism that would lock the door 29A in its closed position, the door 29A would be allowed to freely rotate to any position within the rotational range of the hinge(s) 54, or until the door 29A hits some other portion of the gaming machine 22. A problem with this configuration is that, for example, a user might open the door 29A and it could freely drop to the position illustrated in FIGS. 4A and 4B. This might cause damage to the door 29A or the associated video display 28C or the like.

Thus, in accordance with the invention, an opening and closing control 60 is provided for the door 29A. In one embodiment, and as best illustrated in FIG. 2B, the opening and closing control 60 comprises a scissor arm 62 and a damping mechanism or element 64. As illustrated in FIG. 2B, the scissor arm 62 comprises a first link 66 and a second link 68. The links 66,68 may comprise, for example, metal bars or the like.

As illustrated, a first end of the first link 66 is mounted to the gaming machine cabinet 26 at the interior thereof. The mounting may be direct or indirect, such as by mounting it to a bracket which is connected to the cabinet 26, etc. The mounting preferably allows the position or orientation of the first link 66 to change, and most preferably rotate, relative to the cabinet 26. Thus, in one embodiment, the first end of the first link 66 may be rotatably mounted to the cabinet 26, such as via a pin or the like. In this embodiment, the first end of the first link 66 is mounted to the cabinet at a position adjacent to the top of the door 29A.

Likewise, a first end of the second link 68 is mounted to the door 29A (such as the frame 50 thereof) at the interior thereof. The mounting may be direct or indirect, such as by mounting it to a bracket which is connected to the door 29A, etc. The mounting preferably allows the position or orientation of the second link 68 to change, and most preferably rotate, relative to the door 29A. Thus, in one embodiment, the first end of the second link 68 may be rotatably mounted to the door 29A, such as via a pin or the like. In this embodiment, the first end of the second link 68 is mounted to the cabinet at a position near the middle of the door 29A.

The second end of the first link 66 and the second end of the second link 68 are preferably connected via a connector which allows the positions or orientations of the first and second links 66,68 to change, including relative to one another. In one embodiment, for example, the second ends of the first and second links 66,68 are mounted or joined for rotation relative to one another, such as about a pin, such as at a joint 69.

The damping mechanism 64 preferably comprises a gas or pneumatic shock (although the damping mechanism might comprise other mechanical or electro-mechanical elements including oil shocks and other devices having at least two elements and a means for controlling or limiting the rate of movement of those elements relative to one another, or other devices configured to generate a biasing or opposing force to movement of the scissor arm 62). The shock 64 may have a main body 70 and an extendable arm 72. One end or portion of the shock 64, such as an end of the body 70, may be mounted to the scissor arm 62. In a preferred embodiment, the shock 64 is mounted to the second ends of the first and second links 66,68 of the scissor arm 62, such as at the joint 69. As one example, the same pin which connects or joins the first and second links 66,68 might join the shock 64 thereto. An opposing end of the shock 64, such as an end of the arm 72, may be mounted to the cabinet 26 of the gaming machine 22 (again the mounting may be direct or indirect, such as to a bracket which is connected to the cabinet 26 or the like). In the embodiment illustrated, the opposing end of the shock 64 is mounted to the cabinet 26 in a position below and behind the scissor arm 62 and the door 29A. Again, the mounting preferably permits the position or orientation of the shock 64 to change, preferably by rotation. The mounting may thus comprise a pin or the like. Preferably, the shock 64 is a two-way shock which controls the rate at which the arm 72 moves out of the body 70 and the rate at which the arm 72 may move back into the body 70. Because the shock 64 is mounted to the scissor arm 62, the shock 64 impacts the rate of movement of the scissor arm 62, and thus the door 29A to which it is connected.

Operation of the door in accordance with the invention will now be described. FIGS. 2A and 2B illustrated the door 29A in closed position. Relative to this embodiment gaming machine 22, as illustrated in FIG. 2B, the door 29A is generally vertically extending with the display 29C facing outwardly towards the front of the gaming machine. As further illustrated in FIG. 2B, in this door position, the shock 64 is in a retracted position, e.g. one where the arm 72 is located in the body 70. The scissor arm 62 is in a folded or retracted position as well.

As the user opens the door 29A, the scissor arm 62 and shock 64 begin to expand, as illustrated in FIGS. 3A and 3B. In this embodiment, when the door is approximately half way between its closed and open positions, the first link 66 of the scissor arm 62 has rotated from a folded-in position forwardly towards the front of the gaming machine to a nearly vertical position. In this position, the joint 69 of the first and second links 66,68 of the scissor arm 62 is forward of its original position (as illustrated in FIG. 2B). As such, the top end of the shock 64 has rotated forwardly as well, causing the shock to expand (e.g. the arm 72 is now partially extended out of the body 70).

Finally, FIGS. 4A and 4B illustrate the door 29A in its fully open position. Relative to this embodiment gaming machine 22, the door is nearly vertical, but now extends downwardly with the display 29C facing into the gaming machine 22. In this position, the scissor arm 62 is fully extended or nearly fully extended with the first and second links 66,68 nearly in line with one another. In this position, the joint 69 of the links 66,68 is even farther forward of the earlier described positions. Thus, the shock 64 is rotated further forward and the arm 72 is now further extended out of the body 70.

Various features and advantages or the invention will now be described. Most importantly, when the door 29A is opened, the movement of the door is controlled. In particular, the shock 64 serves to dampen or slow the movement of the scissor arm 62, with thus tends to slow the movement of the door to its open position. This aids in preventing the door 29A from opening too quickly and, for example, hitting other objects or portions of the gaming machine 22 and causing damage to the door, the display 28C or the like. Of course, when the door 29A is closed, the process works in reverse, and the shock 64 may serve to slow movement of the door 29A to its closed position, again protecting the door and associated components, such as if the door 29A were to slam shut.

One aspect of the design of the present invention is that it is relatively simple. In the embodiment just described, only a scissor arm 62 and shock 64 are necessary to provide controlled movement of the door. In this embodiment, the door control 60 has two moving components (the scissor arm 62 and the shock 64), and has two fixed mounting points (the points where the shock 64 and the first link 66 of the scissor arm 62 mount to the gaming machine 22) and two moving mounting points (the points where the shock 64 mounts to the scissor arm 62 and the second link 68 of the scissor arm 62 mounts to the door 29A). In this configuration, one element of the door control 60 is configured to extend linearly (the door shock 64) and controls the angular expansion of the other element (the scissor arm 62).

As noted herein, the door control 60 of the present invention may be used in gaming machines having other configurations than just described. For example, the door control 60 might be used relative to a door which is located at the back/rear or other location of a gaming machine.

It will also be appreciated that the orientation of the door control 60 might vary. In the configuration which is illustrated, the components of the door control 60 are located in a vertical plane and are oriented to allow the door 29A to open downwardly. The orientation of the door control 60 might be inverted or reversed if the door was hinged at the top and opened upwardly. Likewise, the door control 60 could be located in a horizontal plane and then be oriented to allow the door to open to a side. Also, while in one embodiment the lengths of the first and second links 66,68 of the scissor arm 62 are nearly the same, in other embodiments, the lengths of the links might vary.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A gaming machine comprising:

a cabinet defining at least one interior space and having an access door, said access door mounted to said cabinet by at least one hinge allowing said access door to move between a first closed position and a second open position;

at least one display device;

at least one player input device;

a memory device;

a controller;

machine-readable code stored in said memory device and executable by said controller to present one or more wagering games comprising the display of game information via said at least one display device; and an access door control comprising a scissor arm and a shock, said scissor arm comprising a first link having a first end and a second end and a second link having a first end and a second end, said first end of said first link connected to said cabinet, said first end of said second link connected to said access door, and said first and second links pivotally connected to one another, and said shock comprising a shock body and an arm extendable therefrom, said shock mounted to said cabinet and said scissor arm, whereby said shock opposes a pivoting of said first and second links relative to one another.

2. The gaming machine in accordance with claim 1 wherein said second end of said first link and said second end of said second link are pivotally connected at a joint.

3. The gaming machine in accordance with claim 2 wherein said shock is mounted to said scissor arm at said joint.

4. The gaming machine in accordance with claim 3 wherein said shock body is mounted to said scissor arm at said joint and said arm of said shock is mounted to said cabinet.

5. The gaming machine in accordance with claim 4 wherein said shock body is rotatably mounted to said cabinet.

6. The game machine in accordance with claim 1 wherein said first end of said first link is movably mounted to said cabinet and said first end of said second link is movably mounted to said door.

7. The gaming machine in accordance with claim 1 wherein said shock comprises a pneumatic shock.

8. The gaming machine in accordance with claim 1 wherein at least one video display is mounted to said access door.

9. The gaming machine in accordance with claim 1 wherein said access door has a top, a bottom, a first side and a second side, said access door connected to said cabinet via said at least one hinge along said bottom of said access door.

10. The gaming machine in accordance with claim 9, wherein a first end of said shock is connected to said cabinet at a vertical position below said bottom of said access door and said first end of said first link of said scissor arm is connected to said cabinet at a vertical position above said top of said access door.

11. The gaming machine in accordance with claim 1, wherein said access door is mounted to said cabinet for rotation about a horizontal axis and said scissor arm and shock are located in a vertical plane.

12. The gaming machine in accordance with claim 1, wherein said scissor arm and said shock are located in said at least one interior space when said access door is in said first closed position.

13. The gaming machine in accordance with claim 12, wherein said access door has a front facing outwardly of said cabinet and a rear facing inwardly towards said interior area, said first end of said second link connected to said rear of said access door.

14. The gaming machine in accordance with claim 1, wherein said first end of said second link is connected to said access door via a mounting bracket.

15. The gaming machine in accordance with claim 6, wherein said first end of said first link is rotatably mounted to said cabinet and said first end of said second link is rotatably mounted to said access door.

16. A gaming machine comprising:

a cabinet defining at least one interior space and having an access door, said access door mounted to said cabinet by at least one hinge allowing said access door to move between a first closed position and a second open position;

at least one display device;

at least one player input device;

a memory device;

a controller;

machine-readable code stored in said memory device and executable by said controller to present one or more wagering games comprising the display of game information via said at least one display device; and said access door connected to said cabinet by a scissor arm comprising first link and a second link which are pivotally connected to one another, said scissor arm movable between a first collapsed position corresponding to said first closed position of said access door and a second extended position corresponding to said second open position of said door, and a shock comprising a shock body and an arm extendable therefrom, said shock mounted to said cabinet and said scissor arm, said shock exerting a biasing force against movement of said scissor arm between its first collapsed position and its second extended position.

17. The gaming machine in accordance with claim 16, wherein when said scissor arm is in said first collapsed position said first and second links are at a first angle relative to one another and said shock is in a first compressed position and wherein when said scissor arm is in said second extended position said first and second links are at a second angle relative to one another and said shock is a second expanded position.

18. The gaming machine in accordance with claim 16, wherein said first link is connected to said cabinet and said second link is connected to said access door.

19. The gaming machine in accordance with claim 16 wherein said access door is further connected to said cabinet by at least one hinge.

* * * * *